United States Patent [19]

Tam

[11] Patent Number: 4,633,230

[45] Date of Patent: Dec. 30, 1986

[54] COOKING, FIRE, AND BURGLAR ALARM SYSTEM

[76] Inventor: Wee M. Tam, 777 Clay St. #17, San Francisco, Calif. 94108

[21] Appl. No.: 607,232

[22] Filed: May 4, 1984

[51] Int. Cl.[4] ..... G08B 19/00

[52] U.S. Cl. ..... 340/521; 340/501; 340/517; 340/588; 219/453; 219/510

[58] Field of Search ..... 340/521, 522, 584, 595, 340/501, 517, 588, 286 R, 286 M, 596; 219/449, 450, 453, 510

[56] References Cited

U.S. PATENT DOCUMENTS 3,678,511 7/1972 Benedict ..... 340/521
3,688,293 8/1972 Sullivan ..... 340/521
4,088,986 5/1978 Boucher ..... 340/521
4,319,229 3/1982 Kirkor ..... 340/521

*Primary Examiner*—Donnie L. Crosland

[57] ABSTRACT

An alarm system for detecting popular home emergency conditions employs cooking, fire, and burglar sensors. Either or all of these sensors can activate the alarm. The system can produce distingushable alarm signals according to different violated conditions detected by different sensors. Additional functions of fire panic, burglar panic, timing, and using cooking sensor for fire sensing, are provided for convenience. The cooking sensor is equiped with an arm to sense the temperature of a cooking container. Automatic reset and turn off functions are provided for burglar alarming.

21 Claims, 13 Drawing Figures

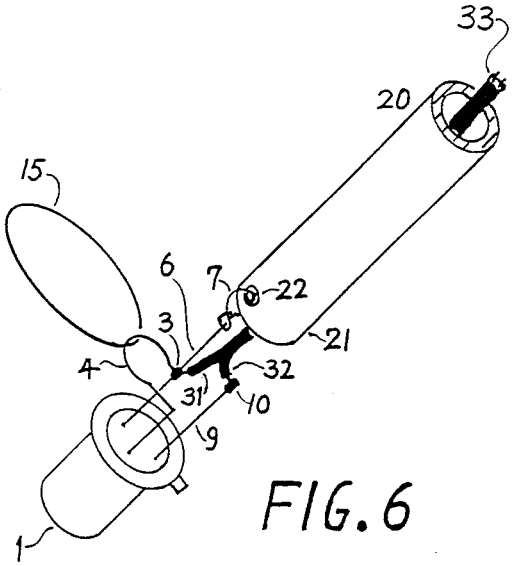
FIG. 6
FIG. 7
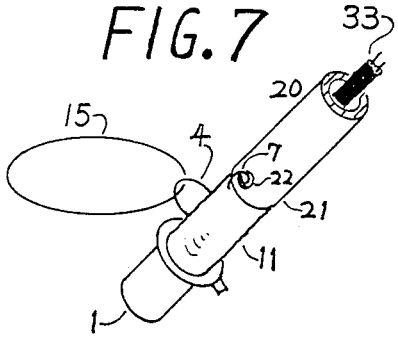
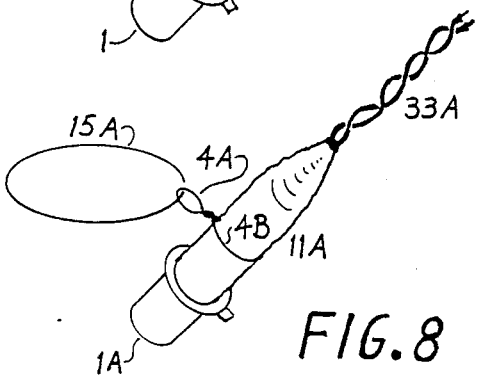
FIG. 8
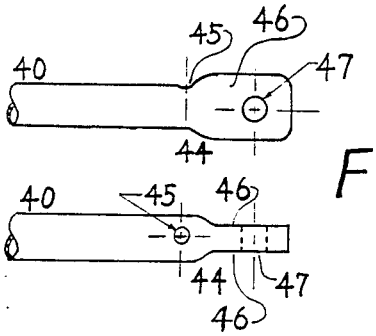
FIG. 9
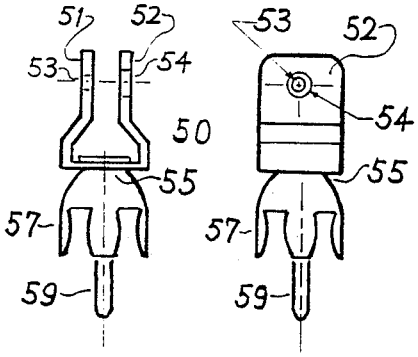
FIG. 10
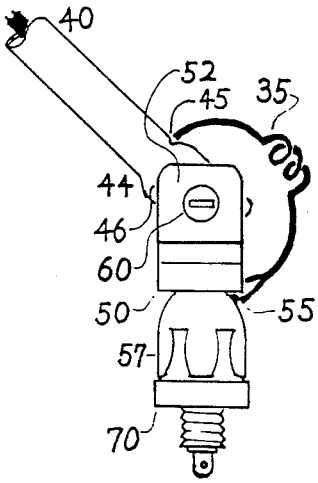
FIG. 11
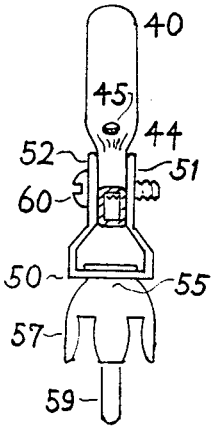
FIG. 12

COOKING, FIRE, AND BURGLAR ALARM SYSTEM

THE CLOSEST RELATED PATENTS

Dennis U.S. Pat. No. 4,315,256 discloses a fire detector having a pair of entwined conductors mounted at the outlet of the chimney.

My invention discloses a fire alarm using a silicon transistor as a fire detector.

Main U.S. Pat. No. 3,859,644 discloses a digital cooking timer responsive to the temperature of a cooking medium.

My invention discloses a cooking alarm using an arm with a silicon transistor to sense the temperature of a cooking container.

Durkee U.S. Pat. No. 3,686,668 discloses a security system for providing an alarm in response to the detection of unauthorized entry of a building.

My invention dicloses a burglar alarm with a closed path of sensor switches and resistors and with automatic reset and turn off functions.

BRIEF SUMMARY OF THE INVENTION

An electronic alarm system for the security of homes has three basic mode operations of cooking, fire, and burglar alarm. It employs an arm having a temperature sensor for cooking sensing, an additional temperature sensor with a pair of low temperature wires for fire sensing and a path of sensor switches and resistors for burglar sensing, provides independent operations of each mode and generates different alarm signals according to each mode operation. Also, more functions and features can be easily added to the system.

BACKGROUND OF THE INVENTION

"Cooking is an art". I am interested in not only electronics engineering but also in music, art, and so on. When I cooked, especially in cooking soup or liquid food, it took minutes and minutes to get the soup boiled. I did not like to waste time in waiting in the kitchen so I usually left the kitchen to watch TV or did something else out of the kitchen. Leaving the kitchen might cause the following problems: water boiling over, food being dried out or damaged. How could I solve these problems while cooking, but doing something rather than wasting time in the kitchen? I once had this question in mind, it occurred to me that there must bave been something like a person to tell me about how the cooking was in a progress. A device with a temperature sensor to sense the temperature of the cooked food could tell me about the temperature of the food.

Although there were different kinds of temperature sensors, for economical and simple reasons, I used a silicon transistor as a temperature sensor. I could directly insert the sensor into the food to sense the temperature of the food, but it was troublesome and the sensor might be dirty. I could also sense the temperature of the food indirectly by sensing the temperature of the cooking container. By experiment, I found that when the food was boiling, the temperature of the cover of the cooking container was in a range from 70 to 95 degree in Celsius, depending on the temperature of the environment, the material of the cover, and the strength of the stove.

I have made an electronic cooking alarm device for some time for my use only because there were some problems to install the device and to sense the temperature of the cooking container. I first tried to install the device on a wall near the stove, but it was difficult to install and inconvenient to use the device. Also, the sensor with a pair of flexible wires looked messy, and the wires might be easily melt or burned when the wires were loose to drop near the stove.

Later I tried and tried to finally find out some methods of no installation for the case of the device and of no damage for the sensor and wires. I use magnets attaching the bottom of the case for no installation since almost all stoves have top iron surfaces, and I use two metal tubes as an arm for no damage for the sensor and wires since the arm can support the sensor and protect the wires inside the tubes.

For more purposes of using the device, I add the other sensors and the related circuits to the device to have a practical home security system.

After researching, I find three U.S. Patents similar to my invention. Dennis U.S. Pat. No. 4,315,256 discloses a fire detector having a pair of entwined conductors mounted at the outlet of the chemney; Main U.S. Pat. 3,859,644 discloses a digital cooking timer responsive to the temperature of a cooking medium; and Durkee U.S. Pat. No. 3,686,668 discloses a security system for a building. But these patents are essentially different from my invention of a cooking, fire, and burglar alarm system for homes.

BRIEF DESCRIPTION OF THE INVENTION

The system has three basic mode operations: cooking, fire, and burglar alarm. They function independently for secure operations.

In the cooking mode operations, a temperature sensor connected the end of an arm senses the temperature of the cooking container in terms of voltage, and the voltage goes through the arm to an amplifier to increase the sensitivity of the sensor. A comparator compares the amplified voltage with a reference voltage which is adjustable for suitable cooking temperature up to 100 degree in Celsius. When the sensor is heated by the cooking container, the sensor voltage decreases. Once the sensor voltage is lower than the adjusted reference voltage, a low level voltage output of the comparator will enable the controls and drive circuits to produce cooking alarming signals. Also, additional functions such as timing, panic alarms, manual controls, and different alarm signaling are included in the cooking mode operations.

In the fire mode operations, there are the same circuits as the circuits in the cooking mode operations except that the temperature of the fire sensor is fixed at about 50 degree in Celsius and the fire sensor is extended by a pair of low temperature wires instead of an arm.

In the burglar mode operations, there are normally open and closed switches for providing sensing means. When any of normal conditions of the switches is violated, a detector detects the situation and triggers an automatic reset and turn off flip-flop to produce burglar alarm signals. The flip-flop will turn off the alarm signals and reset itself in a preset time period.

BRIEF DESCRIPTION OF THE DRAWINGS

FIG. 6 shows the transistor of its fabricated legs shown in FIG. 4 in connections with a pair of electrical wires and with a end of the metal tube.

FIG. 7 is the same as FIG. 6, but the connections of the transistor with the electrical wires and with the end of the metal tube are sealed by insulation cement.

FIG. 8 shows the transistor shown in FIG. 5 being applied insulation cement to the connections of the legs and wires, and shows additional rings.

FIG. 9 is two views of the fabricated end of the metal tube from its original round shape.

FIG. 10 is two views of a specially fabricated phono plug.

FIG. 11 shows the other end of the arm in connections with the plug, electrical wires, and jack.

FIG. 12 is the other view of the end of the arm shown in FIG. 11, but the wires and jack are omitted in drawings for clear illustration.

DESCRIPTION OF THE PREFERRED EMBODIMENT

There are two parts in the description: the mechanical parts and electrical parts. In the mechanical part description, it mainly includes an overview of the system, the sensor, and the arm; the case or enclosure of the system will not be described in details because there are many ways to make the case differently. In the electrical part description, there are detailed circuits which will be described in details, and some function block diagrams which will be described functionally for simplified illustrations because there are many ways to accomplish the same results of the function blocks. Also, for the purpose of promoting an understanding of the principles of the invention, reference will be made to both mechanical and electrical parts.

Mechanical Part Description

Figure 1:
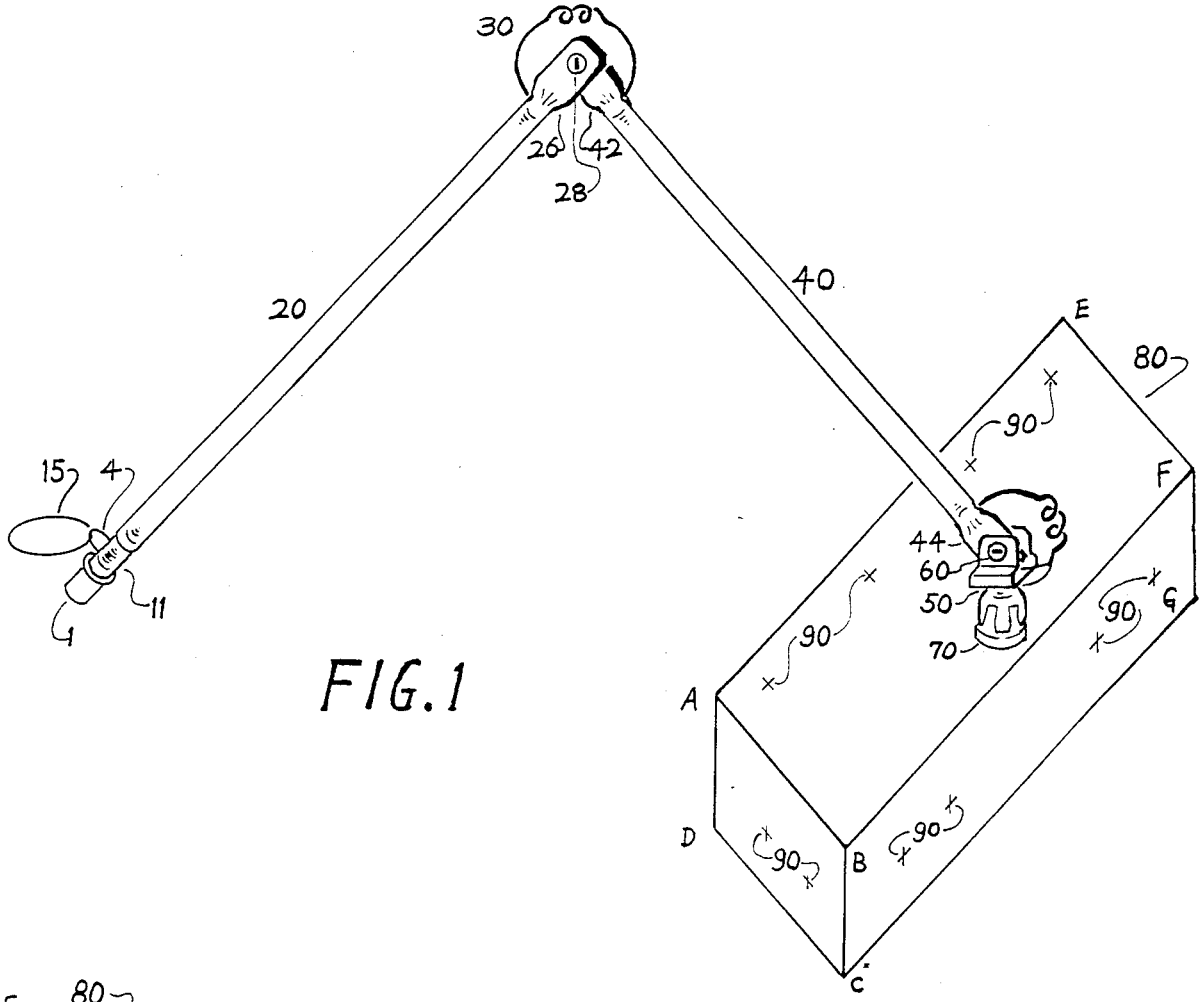
FIG. 1 is an overview of the case of the system showing the arm.

Rererring to FIG. 1, there is an overview of the cooking, fire, and burglar alarm system. It includes sensor 1, semi-ring 4, big ring 15, insulation 11, tube 20 and tube 40 which are joined at the ends 26 and 42 by screw 28, electrical wires 30, end 44 of tube 40 joined with plug 50 by screw 60, jack 70, case or enclosure 80, some holes will be drilled at points 90 for controls, switches, and connectors, and finally some magnets (see FIG. 2).

Figure 2:
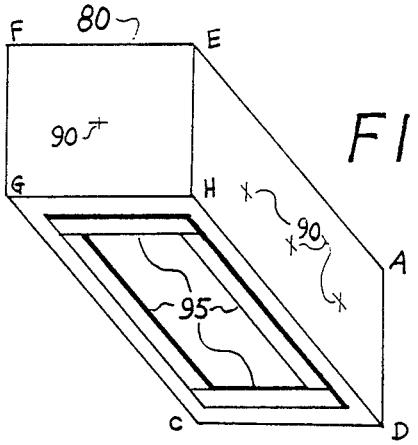
FIG. 2 is a bottom view showing the magnets attaching the bottom of the case.

In FIG. 2, magnet strips or tapes 95 are firmly attached the bottom of the case of the system. Magnet strips 95 are for holding the case of the system on the iron surfaces of stoves.

Figure 3:
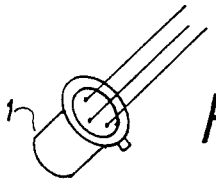
FIG. 3 is a general purpose transistor of metal case.
Figure 4:
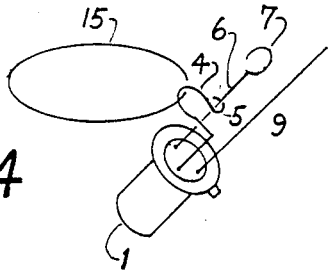
FIG. 4 is the general purpose transistor with its fabricated legs and an added ring of wire.

In FIG. 3, there is general purpose silicon transistor 1 with it legs before fabricated. In FIG. 4, two legs of transistor 1 shown in FIG. 3 have been fabricated. The base leg of transistor 1 is made semi-circle 4, and end 5 of the base leg is hooked on collector leg 6. The end of collector leg 6 is made hook 7. Bigger ring 15 is added in locking chain with semi-circle 4. The functions of ring 15 are for holding transistor sensor 1 on the cover of the cooking container by holding the handle of the cover or for holding the fire sensor on a nail, screw, or hook on the wall or ceiling.

Figure 5:
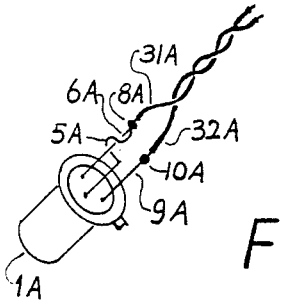
FIG. 5 shows electrical connections of the transistor with a pair of electrical wires.

In FIG. 5, general purpose transistor 1 is fabricated in a simple way in connections with two electrical wires. Base leg 5A is twisted around collector leg 6A, and connection 8A is soldered so the collector, base and electrical wire 31A are connected electrically. Connection 10A is soldered so the emitter, leg 9A and wire 32A is connected electrically.

Referring to FIG. 6, transistor sensor 1 is electrically connected with electrical wires 31 and 32 and mechanically connected with metal tube 20. End 5 of the base leg and collector leg 6 shown in FIG. 4 are now soldered together with wire 31 to form electrical connection 3. Leg 9, the emitter of transistor sensor 1, is soldered with wire 32 to form electrical connection 10. Electrical wires 33 are the extension of wires 31 and 32 and will finally reach plug 50. Hook 7 of leg 6 of transistor sensor 1 is hooked through hole 22 of end 21 of metal tube 20 and is twisted around leg 6 so transistor sensor 1 is mechanically connected with metal bube 20.

In FIG. 7, some insulating and strong cement is applied to space 11 to seal the electrical and mechanical connections for insulation and additional mechanical connections between transistor sensor 1 and end 21 of metal tube 20.

In FIG. 8, transistor sensor 1A from FIG. 5 is applied insulation cement 11A to seal the legs and their connections 8A and 10A shown in FIG. 5. FIG. 8 is similar to FIG. 7 except ring 4A with ring 4B is fabricated from an additional wire rather than from a leg of the transistor 1A, and inFIG. 8, no metal tube is necessary since transistor sensor 1A is hung on the wall or ceiling.

Referring to FIG. 9, FIG. 10, FIG. 11, and FIG. 12, there are illustrations of the other end of the arm which transfers information from transistor sensor 1 to the system and performs mechanical rotation both vertically and horizontally. FIG. 9 illustrates fabricated end 44 of metal tube 40. Hole 45 near end 44 of metal tube 40 is drilled for letting wires 35 go out from metal tube 40, and hole 47 is drilled for screw 60 going through. Flat surfaces 46 are fabricated for being clamped between two wings 51 and 52 of specially fabricated plug 50 shown in FIG. 10. In FIG. 10, diameters of hole 54 are equal to or larger than the outer diameters of screw 60, and hole 53 is threaded the same as screw 60 so no nut is necessary for screwing end 44 of metal tube 40 and plug 50 together. Holes 54 and 53, wings 51 and 52, screw 60, and hole 47 of end 44 of metal tube 40 joining together provide vertical rotation for the arm. Shell 57 and hollow post 59 are the same as the shell and hollow post of a regular phono plug; shell 57 and post 59 and a regular phono jack provide horizontal rotation for the arm.

FIG. 11 shows a complete combinations of connections of metal tube 40, plug 50, wires 35, and jack 70. Electrical wires 35 coming from transistor sensor 1 and going out from hole 45 are retractable, and are soldered on the inner surface of hollow post 59 and surface 55 shown in FIG. 10. Plug 50 will transfer the electrical information to jack 70 which connects the system directly. FIG. 12 shows the other view of the combinations of connections, but wires 35 and jack 70 are omitted in the drawings for clear illustrations.

Electrical Part Description

Figure 13:
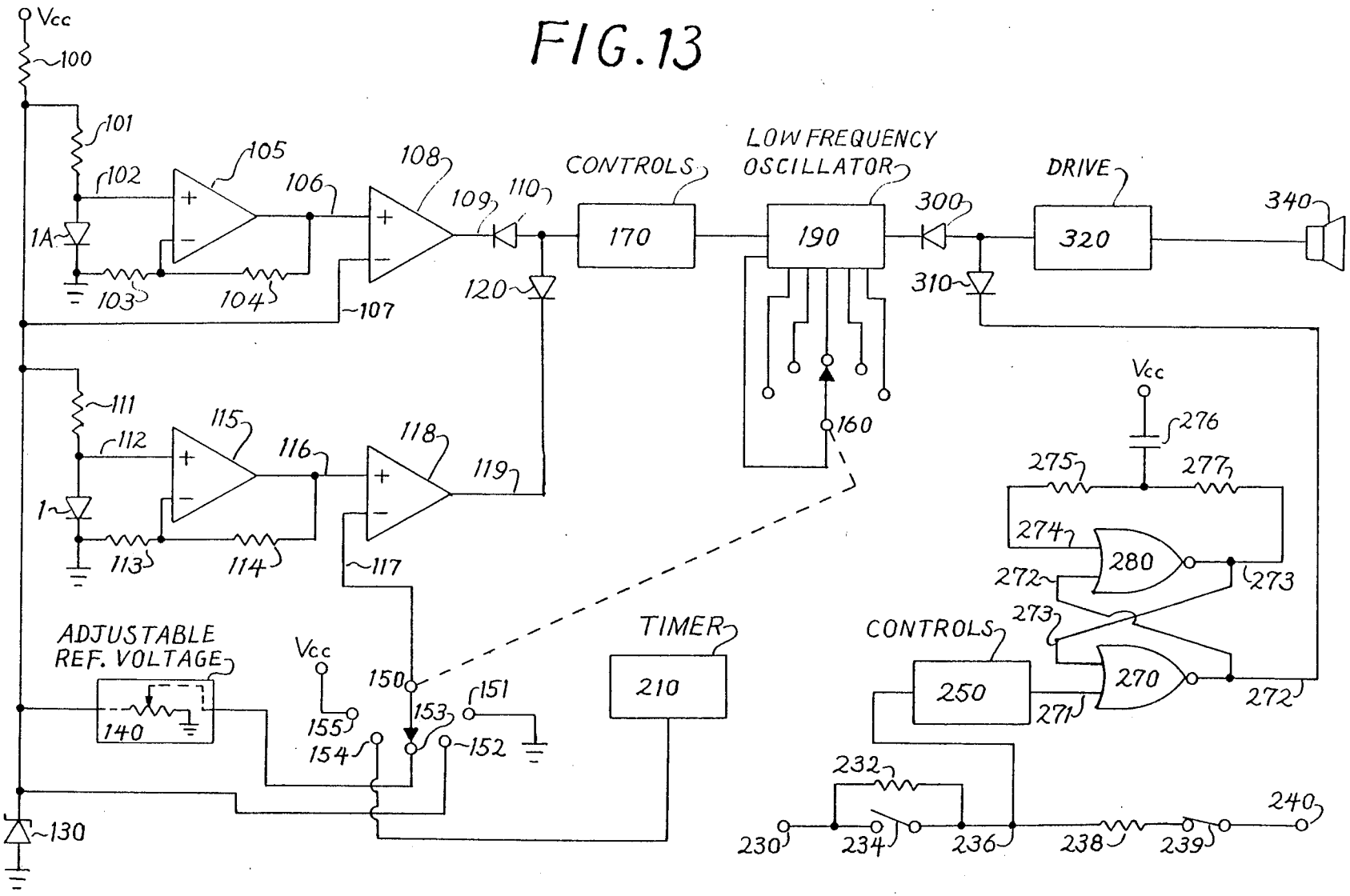
FIG. 13 is an electrical schematic diagram of the system.

Referring to FIG. 13, resistor 100 and zener diode 130 provide constant reference voltage to resistor 101, comparator 108, resistor 111, adjustable reference voltage 140, and position 152 of switch 150. Resistor 101 limits the current to transistor sensor 1A. For high sensitivity of sensing, resistor 103 and resistor 104 set up a gain of op amp 105 to amplify sensing voltage which is the junction voltage 102 of the base and emitter of silicon transistor 1A. Comparator 108 compares output voltage 106 with reference voltage 107 to generate either low or high voltage 109. Normally, voltage 106 is set higher than reference voltage 107 so voltage 109 is high and controls 170 are not enabled. If transistor sensor 1A is heated, junction voltage 102 will decrease by 2 mV per degree Celsius, and voltage 106 will decrease more by the gain factor of op amp 105. When voltage 106 drops below reference voltage 107, output voltage 109 is low, and diode 110 conducts to enable controls 170 to operate. Resistor 111, transistor sensor 1, op amp 115, resistor 113, resistor 114, comparator 118, and diode 120 have the same functions as that of 101, 1A, 105, 103, 104, 108, and 110, respectively.

Adjustable reference voltage 140 is basically a variable resistance network for users to adjust for a certain voltage level for suitable cooking temperature.

Controls 170 contain a flip-flop to be triggered by low level voltages 109 or 119 or both, a transient suppressor to eliminate fraud alarms, a pushbutton switch to disable alarming, and an automatic reset circuit.

Switch 150 is a mode selector for users to set for additional mode operations. Positions 151, 152, 153, 154, and 155 are for selected mode operations of burglar panic, cooking sensor for fire sensing, temperature sensing cooking, timing, and fire panic, respectively. Different alarm signals of different mode operations are accomplished by very low frequency oscillator 190 which generates square waves of different frequencies, high or low output voltages.

Adjustable timer 210 is for users to set timing for convenience in cooking.

Sensor switch 234 is normally open and sensor switch 239 is normally closed. Resistor 232 and resistor 238 provide appropriate bias to controls 250. Controls 250 include voltage detecting, transient suppressing, and instant and delay triggering circuits. For logic level voltage sensing, the ratio of values of resistor 232 to resistor 238 is larger than ten. Point 236 can be low level or high level for the requirements of detecting circuit in controls 250, depending on the polarity of terminals 230 and 240. If terminal 230 is connected to the positive side of the power supply, and terminal 240 is connected to the negative side of the power supply, then point 236 is low, and viceversa. By closing normally open switch 234, or by opening normally closed switch 239, or by doing both, the potential at 236 will change; the detecting circuit in controls 250 will detect the changing condition and trigger an automatic reset and turn off flip-flop consisting of two NOR gates 270 and 280, capacitor 276, resistors 275 and 277. Resistor 277, capacitor 276, and resistor 275 in connections with NOR gate 280 constitute automatic reset and turn off functions. When the power supply is turned on, capacitor 276 is immediately charged from the positive terminal Vcc, and a positive voltage applies to input 274 of NOR gate 280 through resistor 275; consequently, output 273 of gate 280 is low. Capacitor 276 will discharge through the time constant of resistor 277 and capacitor 276, and point 278 later becomes low, and so does input 274. Two-input NOR gate 270 with all its inputs 271 and 273 of low levels has a high level output 272. Because the cathode of diode 310 is positive, diode 310 does not conduct and does not enable drive circuits 320. As any of sensing switches 234 and 239 is violated, input 271 of gate 270 becomes high, output 272 of gate 270 is low, and diode 310 conducts to enable drive circuits 320. Meanwhile, output 273 of gate 280 is high because inputs 274 and 272 are low. High level voltage at output 273 will go through the time delay of resistor 277 and capacitor 276 to reach input 274 to make output 273 become low later. When the normal conditions of sensing switches 234 and 239 have been restored, input 271 returns low; low levels at inputs 273 and 271 make output 272 high to disable drive circuits 320. Also, low level at output 273 will later set input 274 low for normal operation of the flip-flop of NOR gates.

Diodes 300 and 310 allow low level driving voltages from very low frequency oscillator 190 and from output 272 of NOR gate 270 to enable drive circuits 320 independently. Low level voltages at the cathode of diode 300 or of diode 310 enable drive circuits 320 to drive buzzer 340 continuously. Square waves coming from oscillator 190 at the cathode of diode 300 gate drive circuits 320 at a on-off rate as the same frequencies of the square waves. High level voltages at the cathode of diodes 300 and 310 disable drive circuits 320, and buzzer 340 is off.

What is claimed is:

1. A cooking, fire, and burglar alarm system comprising:

first electrical sensor means connected to an arm for sensing the temperature of a cooking container and converting said temperature to first electrical signals;

first amplifier means connected to said arm for amplifying said first electrical signals;

first comparator means connected to said amplifier for comparing said amplified signals with an adjustable stable reference signal, and generating either low or high control voltage;

second electrical sensor means connected to a pair of low temperature electrical wires for sensing the temperature of environment and converting said temperature to second electrical signals;

second amplifier means connected to said wires for amplifying said second electrical signals;

second comparator means connected to said second amplifier means for comparing said second electrical signals with a stable reference signal, and generating another either low or high control voltage;

first independent operation means connected to said first comparator means and said second comparator means for providing independent operations of cooking alarm sensing mode and environment alarm sensing mode, said independent operation means further connected to a first control circuitry which examines and conditions said control voltages and another said control voltages;

a low frequency oscillator means connected to said control circuitry for generating low frequency driving voltages, said low frequency oscillator means further connected to a multiple position switch means which can be operated manually to select said driving voltage of different frequencies according to different positions of said multiple position switch, said multiple position switch further connected to said comparator, negative power supply reference voltage, said stable reference signal, said adjustable stable reference signal, a timer, and positive power supply reference voltage, for providing burglar panic, cooking sensor for fire sensing, temperature sensing cooking, timing cooking, and fire panic;

a burglar alarm sensing means for providing normal electrical signals when said sensing means is not violated, and providing abnormal electrical signals when said sensing means is violated, said normal electrical signals and abnormal electrical signals further being examined and conditioned by a second control circuit which is connected to said burglar alarm sensing means;

an automatic reset and turn off means connected to said control circuit for providing starting monitoring operations of said burglar alarm sensing means at the beginning when the power of said system is turned on, enabling alarming for at least a preset timing period when any of the normal conditions of said burglar alarm sensing means has been violated, and disabling alarming and restarting monitoring operations of said burglar alarm sensing means when said normal conditions of said burglar alarm sensing means have been restored;

second independent operation means connected to said low frequency oscillator means and to said automatic reset and turn off means for providing independent operations of said cooking alarm sensing and fire alarm sensing modes, and of burglar alarm sensing mode; and a drive circuit means connected to said second independent operation means for generating driving power to an audible means which produces audible alarm signals.

2. An alarm system of claim 1, further comprising a holding means mechanically connected to a case or enclosure for holding said case or enclosure of system on a surface without installation.

3. An alarm system of claim 2, wherein said holding means includes magnet strips or pieces attached the bottom of said case or enclosure.

4. An alarm system of claim 1, wherein said electrical sensor means includes a semiconductor having a function of temperature.

5. An alarm system of claim 4, wherein said semiconductor includes a silicon transistor having a voltage function of temperature between a junction of the base and emitter of said transistor.

6. An alarm system of claim 1, wherein said arm includes:

an electrical wire means connected said electrical sensor for conducting said electrical signals to said system;

a supporting means mechanically connected to said electrical sensor for supporting said electrical sensor between said cooking container and said case or enclosure and protecting said electrical wire means;

an insulation means connected to said electrical sensor and an end of said supporting means for providing electrical insulation and mechanical connections between said electrical sensor and said end of said supporting means;

a mechanical means mechanically connected to said electrical sensor for holding said electrical sensor on said cooking container; and a mechanical and electrical means connected to the other end of said supporting means and said wire means for providing mechanical connections between other said end of said supporting means and said case or enclosure, providing mechanical movement in space for said supporting means, and providing electrical connection between wire means and said amplifier means of said system.

7. An alarm system of claim 6, wherein said electrical wire means includes a pair of high temperature wires connected to said electrical sensor, going through said supporting means.

8. An alarm system of claim 6, wherein said supporting means includes a pair of metal tubes which are jointed together at two end for providing movement of each other.

9. An alarm system of claim 6, wherein said insulation means includes plastic rubber cement having electrical insulating property and strong connecting strength.

10. An alarm system of claim 6, wherein said mechanical means includes a small hook and a ring which are fabricated from the legs of said transistor sensor, or rings which are fabricated from additional wires, and a big ring or hook in a locking chain with said small hook or ring.

11. An alarm system of claim 6, wherein said mechanical and electrical means includes a plug mechanically connected to the other end of said supporting means and electrically connected to said wire means from said electrical sensor, and a jack mechanically and electrically connected to said plug, said jack mechanically connected to said case or enclosure and electrically connected to said amplifier of said system, 12. An alarm system of claim 11, wherein said plug and jack includes a phono plug and phono jack connected together, and said phono plug jointed with the end of said jointed metal tubes by a screw going through a hole of one wing of said phono plug, through a hole of said end of said jointed metal tubes and through a threaded hole of the other wing of said phono plug, said phono plug also electrically connected to said high temperature wires, said phono jack mechanically connected to said case or enclosure of said system and electrically connected to said amplifier of said system.

13. An alarm system of claim 1, wherein said amplifier means includes an operational amplifier.

14. An alarm system of claim 1, wherein said comparator means includes a voltage comparator.

15. An alarm system of claim 1, wherein said stable reference signal is constructed by a resistor and zener diode connected in series and connected to said power supply of said system.

16. An alarm system of claim 1, wherein said adjustable stable reference signal is provided by a potentiometer connected to said stable reference signal and said negative power supply reference.

17. An alarm system of claim 1, wherien said independent operation means includes an OR circuit.

18. An alarm system of claim 17, wherein said OR circuit includes diodes which the anodes of said diodes are connected in common.

19. An alarm system of claim 1, wherein said burglar alarm sensing means includes a path consisting of at least a mormally closed switch connected to a resistor in series, and at least a normally open switch connected to a resistor in parallel, and said path further connected to two terminals of said power supply of said system.

20. An alarm system of claim 1, wherein said automatic reset and turn off means includes a timing circuit connected to a flip-flop circuit.

21. An alarm system of claim 20, wherein said timing circuit includes resistors connected to an input and an output of said flip-flop, and a capacitor connected to said resistors and to said power supply.

* * * * *